US005301936A

United States Patent [19]

Matsumoto

[11] Patent Number: 5,301,936

[45] Date of Patent: Apr. 12, 1994

[54] FEEDING DEVICE AND METHOD FOR DETERMINING FEEDING POSITION BY FEEDING NUMBER IN BOTH A LONGITUDINAL AND LATERAL POSITION

[75] Inventor: Manabu Matsumoto, Nara, Japan

[73] Assignee: Sharp Kabushiki Kaisha, Osaka, Japan

[21] Appl. No.: 920,820

[22] Filed: Jul. 28, 1992

[30] Foreign Application Priority Data

Jul. 30, 1991 [JP] Japan ..... 3-189782

[51] Int. Cl.[5] ..... B65H 3/44

[52] U.S. Cl. ..... 271/9; 271/164

[58] Field of Search ..... 271/9, 145, 162, 164

[56] References Cited

U.S. PATENT DOCUMENTS 5,028,042 7/1991 Yamada et al. ..... 271/9

5,052,671 10/1991 Matsuo .

5,065,995 11/1991 Iwamoto et al. .

*Primary Examiner*—D. Glenn Dayoan

*Assistant Examiner*—Boris Milef

[57] ABSTRACT

A feeding device provided with a cassette rotatable between a longitudinal feed position from which paper is fed in a longitudinal direction and a lateral feed position from which paper is fed in a lateral direction and a feeding number memory for storing respective feeding numbers in a longitudinal direction and a lateral direction of the rotatable cassette. The feeding device is controlled such that after setting a priority of the feed direction of the rotatable cassette based on data stored in the feeding number memory, the rotatable cassette is rotated in the priority of the feed direction. As a result, the feeding device provides a more convenient and efficient operating process.

19 Claims, 10 Drawing Sheets

S31
POWER SWITCH "ON" FLAG-S ?
NO
YES
S32
POWER SWITCH "ON" FLAG-R
S33
SET CASSETTE ROTATING SIGNAL FOR PRIORITY POSITION
S34
COPYING OPERATION ?
NO
YES
S35
SET TIMER T1
S36
ALL CLEAR KEY "ON" ?
NO
YES
S37
ALL CLEAR RESERVE FLAG-S
S38
ANY KEY "ON"?
NO
YES
S39
SET TIMER T1
S40
ALL CLEAR RESERVE FLAG-S ?
NO
YES
S41
ALL CLEAR RESERVE FLAG-R
S42
ALL CLEAR KEY "ON"?
NO
YES
S43
TIMER T1 TIME-UP ?
NO
YES
S44
SET TIMER T1
2
2

FEEDING DEVICE AND METHOD FOR DETERMINING FEEDING POSITION BY FEEDING NUMBER IN BOTH A LONGITUDINAL AND LATERAL POSITION

FIELD OF THE INVENTION

The present invention relates to a feeding device provided with rotatable cassettes which rotate between a longitudinal feed position from which paper is fed in a longitudinal direction and a lateral feed position from which paper is fed in a lateral direction.

BACKGROUND OF THE INVENTION

In a conventional feeding device designed for copying machines, etc., a rotatable cassette is generally provided. The rotatable cassette is designed such that a priority of a feed direction is set beforehand. Accordingly, the rotatable cassette rotates in the priority of the feed direction when a power switch is turned ON, or a predetermined elapse of time has passed in the stand-by state for the copying operation.

In addition, a feeding device provided with a plurality of the above-mentioned rotatable cassettes is also proposed. In this type of feeding device also, the priority of the feed direction is set beforehand for each rotatable cassette.

However, the above conventional feeding devices present the following problem. That is, a priority feed position of the rotatable cassette is fixed to a position set in an initial state. This means that if a user's desired copying direction (the most often used copying direction) differs from the fixed priority feed direction, an additional operation is required to rotate the rotatable cassette to the desired feed position, causing inefficiency and inconvenience in operating procedures.

SUMMARY OF THE INVENTION

An object of the present invention is to provide feeding device which achieves a more efficient and convenient operating process by automatically setting rotatable cassettes in the most often used feed direction.

In order to achieve the above object, the feeding device in accordance with the present invention includes:

(a) paper storing means rotatable between a longitudinal feed position from which paper is fed in a longitudinal direction and a lateral feed position from which paper is fed in a lateral direction;

(b) rotation drive means for rotating said paper storing means to the longitudinal position or to the lateral position;

(c) feeding number memory means for storing respective feeding numbers in the longitudinal direction and the lateral direction from said paper storing means; and (d) control means for determining a priority of a feed direction based on data stored in said feeding number memory means and controlling said rotation drive means so as to rotate said paper storing means in the priority of the feed direction.

According to the above arrangement, the priority of the feed direction can be set in the more often used feed direction based on data regarding the feeding number in the longitudinal direction from the rotatable cassette and the feeding number in the lateral direction from the rotatable cassette. Accordingly, the rotatable cassette can be rotated in the set priority direction. In this way, an additional operation is not required for a user to rotate the rotatable cassette, whereby a more efficient and convenient operating process can be achieved.

Further, in the case where papers of the same size are stored in a plurality of rotatable cassettes, a feeding number in a longitudinal direction is compared with a feeding number in a lateral direction from respective rotatable cassettes, and the priority of feed direction is set to be the most often used feed direction, and a rotatable cassette with the shortest paper feed path is set to be a priority cassette. As a result, the time required for a fast copying can be reduced as well.

The invention and its various advantages will become more apparent to those skilled in the art from the ensuing detailed description of preferred embodiments, reference being made to the accompanying drawings.

BRIEF DESCRIPTION OF THE DRAWINGS

FIG. 1(*b*) is a flow chart showing the control operation of a controller when a rotatable cassette is deviated from a predetermined feed direction.

FIG. 6(*b*) is an enlarged perspective view showing a nut member shown in FIG. 6(*a*) and the periphery thereof.

FIG. 7(*b*) is a front view of a cassette operation section of the operation panel.

DETAILED DESCRIPTION OF PREFERRED EMBODIMENTS

The following description describes one embodiment of the present invention with reference to FIGS. 1 to 9. The present embodiment is discussed through an example where the feeding device is provided in a copying machine.

Figure 4:
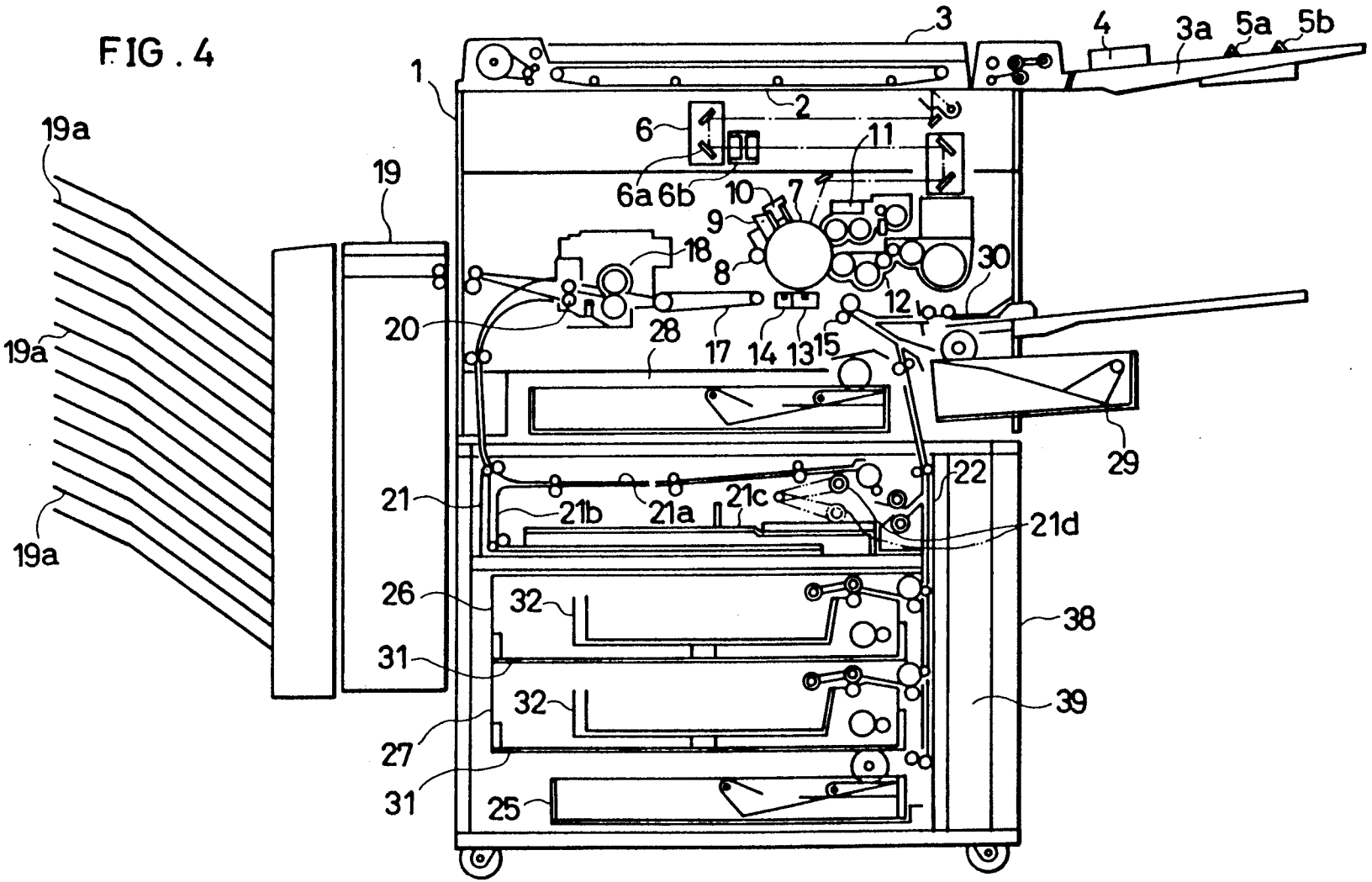
FIG. 4 is a view showing the whole structure of a copying machine provided with a feeding device of the present invention.
Figure 5:
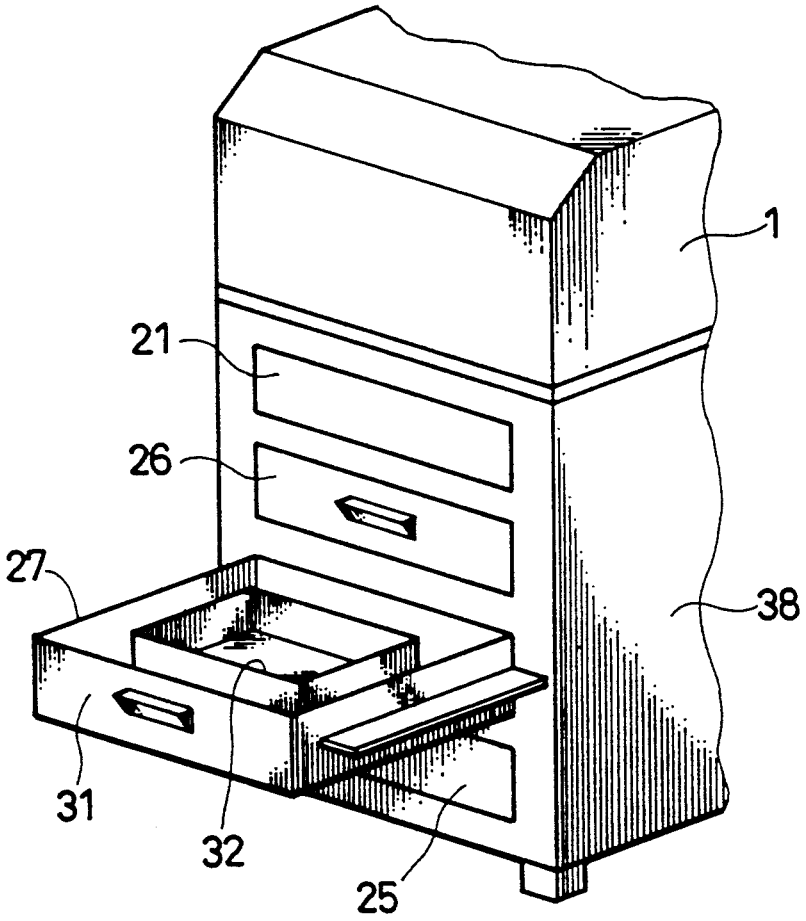
FIG. 5 is a perspective view showing a part of the copying machine shown in FIG. 4, wherein a second rotatable cassette is drawn out.

As shown in FIG. 4, a copying machine in accordance with the present embodiment is provided with a desk 38 under a main body 1, a sorter 19 at the paper discharging side of the main body 1 and an automatic document feeder 3 (hereinafter referred to as ADF) on the main body 1. As shown in FIG. 5, the desk 38 is provided from top to bottom with a duplex/composite unit 21, a first rotatable cassette unit 26, a second rotatable cassette unit 27 and a third fixed cassette 25. The first and second rotatable cassettes 26 and 27 respectively include rotatable cassettes 32 rotatable within an outer case 31.

The document placing tray 3*a* of the ADF 3 is provided thereon feed direction switches 5*a* and 5*b* for detecting the size in the feed direction of a document, and a guide 4 for guiding the document not so as to be shifted in a direction perpendicular to the feed direction. The guide 4 includes a document size detection switch (not shown) for detecting the width of a document.

Under the original glass plate 2, disposed is an optical system 6 having a basic function for guiding a reflected light from the document into a photoreceptor drum 7, which is designed in order to perform variable magnification copying such as image reduction and image enlargement in addition to same size copying, the optical system 6 comprising a plurality of reflecting mirrors 6*a* and a lens 6*b*.

Disposed along the photoreceptor drum 7 are a cleaner 8, an eraser 9, a main charger 10, a developing device 11 having toners for color copying, and a developing device 12 having toner for black-and-white copying. Disposed under the photoreceptor drum 7 are a transferring charger 13 and a separating charger 14. In the feed direction of the photoreceptor drum 7, a conveyor belt 17 and a fixing device 18 are provided.

After passing through the fixing device 18, paper (i.e. copy material) is basically discharged to discharge trays 19*a* through a sorter 19. In the cases of duplex copying and composite copying, paper is guided from a paper returning path 20 to the duplex/composite unit 21. In duplex copying, the paper is guided to a paper feed path 22 after passing through a first delivery path 21*a*, an intermediate tray 21*c* and a delivery roller 21*d*. In composite copying, the paper is guided to the paper feed path 22 after passing through a second delivery path 21*b*, the first delivery path 21*a*, the intermediate tray 21*c* and the delivery roller 21*d*. The end of the paper feed path 22 reaches a paper stop roller 15 disposed in the vicinity of the photoreceptor drum 7.

Paper is properly fed to the paper feeding path 22 from a plurality of paper feeding means connected thereto. More specifically, there are provided, in the order of increasing distance to the paper stopping roller 15 disposed in the main body 1, a manual paper feeder 30, a first fixed cassette 29, a second fixed cassette 28, the duplex/composite unit 21, the first rotatable cassette unit 26, the second rotatable cassette unit 27 and the third fixed cassette 25.

The first fixed cassette 29 is capable of storing 500 sheets, and the second and the third fixed cassettes 28 and 25 are respectively capable of storing 250 sheets.

A set of cassettes of the feeding device 39 consists of the first fixed cassette 29 and the second fixed cassette 28 disposed in the main body 1, the first and the second rotatable cassette units 26 and 27 and the third fixed cassette 25 disposed in the desk 38.

The fixed cassettes 29, 28 and 25 and the rotatable cassette units 26 and 27 are all detachable from the copying machine.

Figure 6:
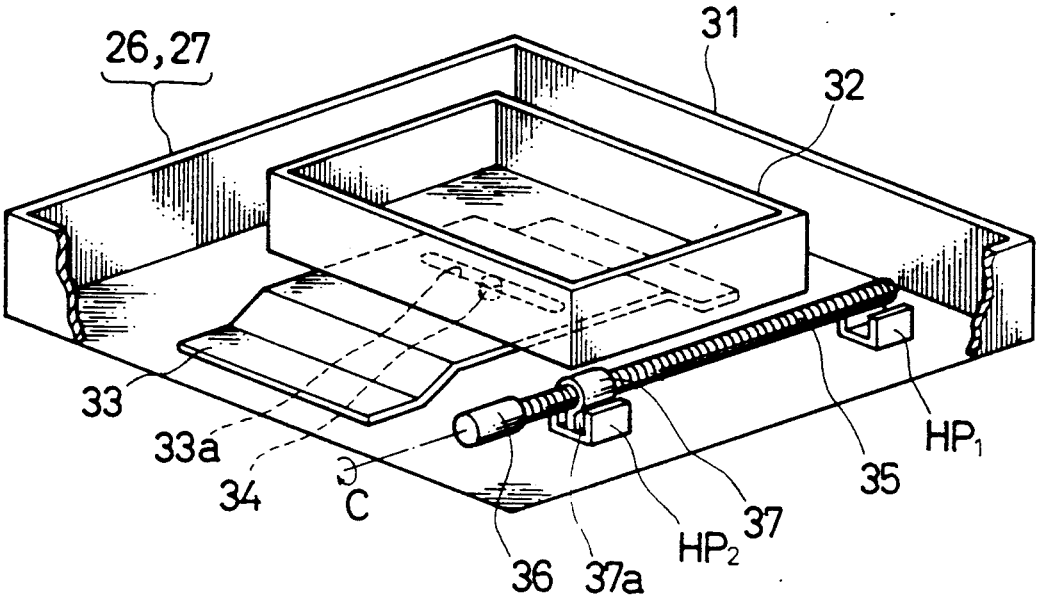
FIG. 6(*a*) is a partial sectional perspective view of a first rotatable cassette and a second rotatable cassette shown in FIG. 4.
Figure 6:
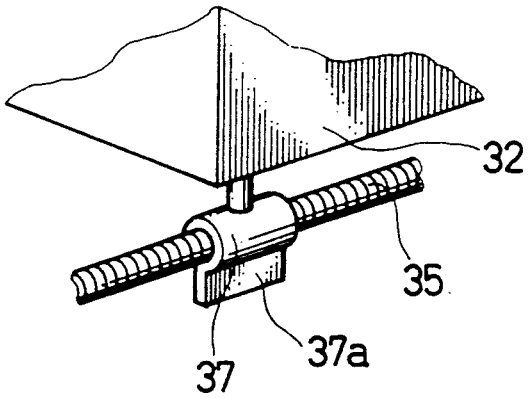

As shown in FIG. 6(*a*), the first and the second rotatable cassette units 26 and 27 are respectively provided with the outer case 31 and the rotatable cassette 32 disposed within the outer case 31. The rotatable cassette 32 serves as a paper storing means for storing paper of a predetermined size.

The rotatable cassette 32 has a rotating plate (not shown) for raising paper stored in the rotatable cassette 32 as the number of papers is decreased. The outer case 31 has a cassette supporting plate 33 at the bottom wall, the center portion thereof being apart from the bottom wall of the outer case 31.

A guide hole 33*a* in the form of an oblong circle is disposed at the center portion of the cassette supporting plate 33 with its major diameter parallel to a paper feed direction. At the back face of the rotatable cassette 32, provided is a guiding shaft 34 which projects downward so as to pierce the guide hole 33*a*.

The outer case 31 is provided with a threaded shaft 35 positioned parallel to a plane perpendicular to the feed direction from the rotatable cassette 32 and the bottom wall of the outer case 31. The threaded shaft 35 is rotatably supported by bearings (not shown) and coupled with a cassette rotation motor 36 at one end thereof, so as to rotate in clockwise (CW) and counterclockwise (CCW) directions.

A nut member 37 is fitted to the threaded shaft 35 such that the nut member 37 reciprocates along the threaded shaft 35 by the CW/CCW rotations of the threaded shaft 35. As shown in FIG. 6(*b*), the upper end of the nut member 37 is pivotally connected to a corner of the rotatable cassette 32, and a light interrupting member 37*a* is formed at the lower part of the nut member 37. Transmission means essentially consists of the threaded shaft 35 and the nut member 37, which transmits the drive force generated by the cassette rotation motor 36 to the rotatable cassette 32.

A lateral feed position sensor $HP_1$ and a longitudinal feed position sensor $HP_2$ are respectively provided on the bottom wall of the outer case 31 in the neighborhood of both ends of the threaded shaft 35. The sensors $HP_1$ and $HP_2$ are photointerrupters each having a light emitting element and a light receiving element. The sensor $HP_1$ is provided for detecting that the rotatable cassette 32 is rotated to the predetermined lateral feed position, and the sensor $HP_2$ is provided for detecting that the rotatable cassette 32 is rotated to the predetermined longitudinal feed position.

When the rotatable cassette 32 moves to the predetermined feed position, (i.e., either of the lateral and longitudinal feed positions), either of the sensors $HP_1$ and $HP_2$ detects that light from the light emitting element to the light receiving element is interrupted by the light interrupting member 37*a*, thereby detecting the movement of the rotatable cassette 32 to the predetermined feed position.

It should be additionally noted here that the sensors $HP_1$, and $HP_2$ are not limited to photointerrupters, but may be magnetic sensors, contact type switches or other similar devices.

Figure 7:
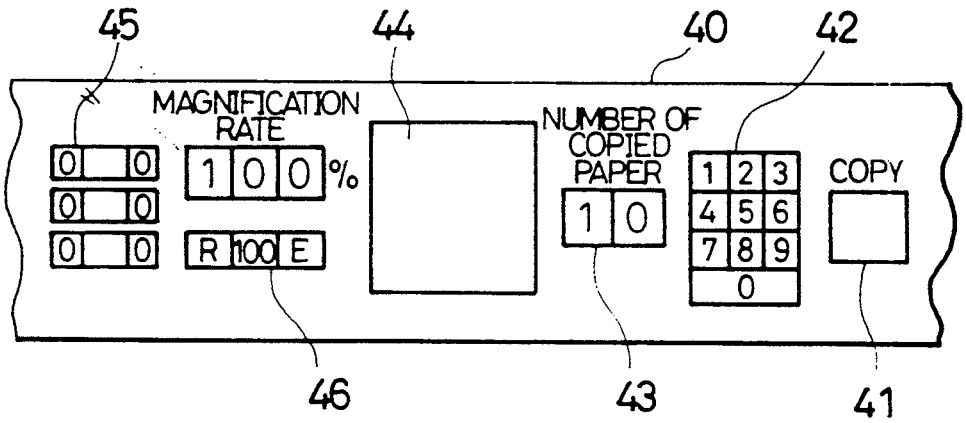
FIG. 7(*a*) is a front view of an operation panel.
Figure 7:
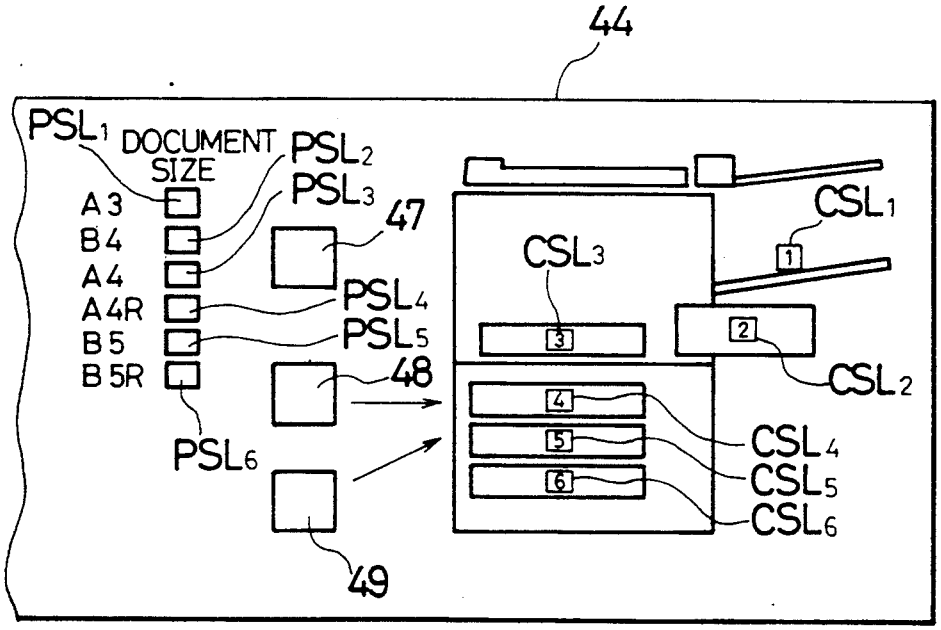

The main body 1 is provided with an operation panel 40 at the upper face thereof shown in FIG. 7(*a*). The operation panel 40 includes a "copy" button 41 for instructing to start a copying operation, ten keys 42 having a plurality of numeral keys for setting the number of copies, etc., a copy number display 43, a cassette operation unit 44, a magnification display 45 and magnification setting keys 46.

As shown in FIG. 7(*b*), the cassette operation unit 44 is provided with a cassette changeover key 47 (selection-specifying input means) for selecting a cassette, cassette rotation keys 48 and 49 (position-specifying input means) for instructing to rotate the respective rotatable cassettes 32 in the first and second rotatable cassette units 26 and 27 and others.

The cassette operation unit 44 is further provided with paper size display lamps $PSL_1$ to $PSL_6$, and cassette display lamps $CSL_1$ to $CSL_6$ for indicating the manual paper feeder 30, the first fixed cassette 29, the second fixed cassette 28, the first rotatable cassette unit 26, the second rotatable cassette unit 27 and the third fixed cassette 25 by the numbers "1" to "6" in this order. The cassette display lamps $CSL_1$ to $CSL_6$ are selectively lighted in accordance with the selection of the rotatable cassette units 26 and 27, the fixed cassettes 25, 28 and 29, and the manual paper feeder 30 executed by operating the cassette changeover key 47.

More specifically, if the rotatable cassette unit 26 storing A4 size paper is selected by pressing the cassette changeover key 47, the cassette display lamp $CSL_4$ and the paper size display lamp $PSL_3$ are lighted, thereby indicating that the A4-size paper being stored in the first rotatable cassette unit 26 is selected. Thereafter, if the cassette rotation key 48 is operated so that the rotatable cassette 32 is rotated from the lateral feed position to the longitudinal feed position, the lightning of the paper size display lamp changes from $PSL_3$ to $PSL_4$, thereby indicating that A4R-size paper is selected.

In the above case, if there is no paper stored in a cassette selected from the rotatable cassette units 26 and 27, fixed cassettes 25, 28 and 29 and the manual paper feeder 30, the paper size display lamps $PSL_1$ to $PSL_6$ are not lighted.

Figure 8:
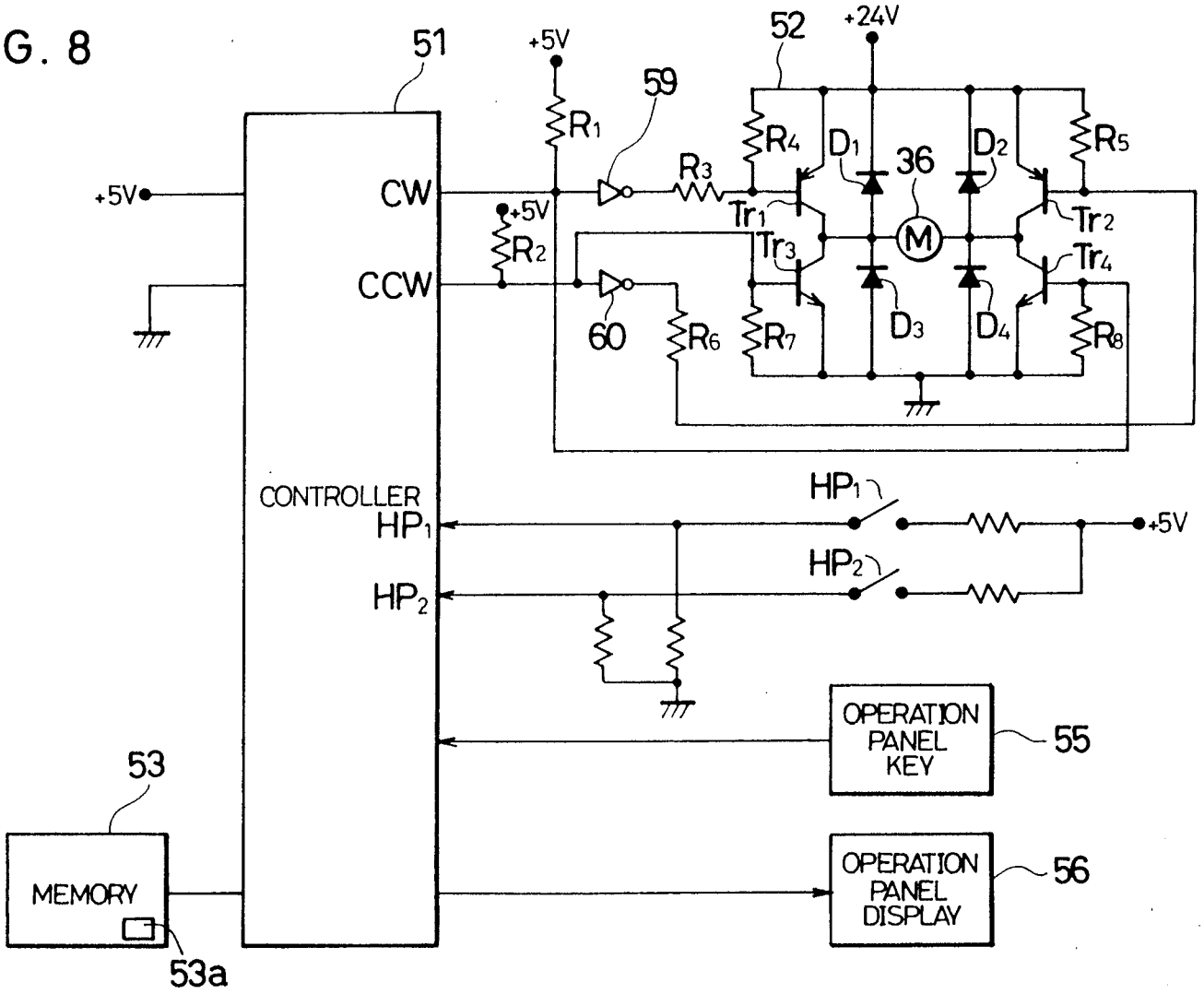
FIG. 8 is a block diagram showing the structure of a control device.

As shown in FIG. 8, the copying machine is provided with a controller 51 which functions as control means. The controller 51 is connected to a motor drive circuit 52, the sensors $HP_1$ and $HP_2$, operation panel keys 55, an operation panel display unit 56 and a memory 53 which functions as feeding number memory means for storing feeding numbers in the respective feed directions.

The feeding device 39 includes the first, second and third fixed cassettes 29, 28 and 25, the first and second rotatable cassette units 26 and 27, transport means for taking out papers from the above cassettes and transporting the papers, the controller 51, the motor drive circuit 52 and the cassette rotation motor 36, a memory 53 and others.

Although not shown in FIG. 8, the motor drive circuit 52 and the cassette rotation motor 36 are independently provided in both first and second rotatable cassette units 26 and 27.

The motor drive circuit 52 is provided with pull-up resistors $R_1$ and $R_2$, NOT circuits 59 and 60, transistors $Tr_1$ to $Tr_4$, resistors $R_3$ to $R_8$ and diodes $D_1$ to $D_4$ which function as surge absorbers, and is arranged to drive the cassette rotation motor 36 so as to rotate CW and CCW directions in accordance with the output from the controller 51.

The pull-up resistor $R_1$, the input terminal of the NOT circuit 59 and the base of the transistor $Tr_4$ are respectively connected to an output terminal CW of the controller 51. The output terminal of the NOT circuit 59 is connected to the base of the transistor $Tr_1$ via the resistor $R_3$.

The base of the transistor $Tr_1$ is connected to one end of the resistor $R_4$, and the base of the transistor $Tr_2$ is connected to one end of the resistor $R_5$. The other respective ends of the resistors $R_4$ and $R_5$, the emitters of respective transistors $Tr_1$ and $Tr_2$, the cathodes of the diodes $D_1$ and $D_2$ are mutually connected, and voltage of +24V is applied to the connecting point of the above.

The collector of the transistor $Tr_1$ and the anode of the diode $D_1$ are connected to one input terminal of the cassette rotation motor 36, and the collector of the transistor $Tr_2$ and the anode of the diode $D_2$ are connected to the other input terminal of the cassette rotation motor 36.

The pull-up resistor $R_2$, the input terminal of the NOT circuit 60 and the base of the transistor $Tr_3$ are connected to the output terminal CCW of the controller 51. The output terminal of the NOT circuit 60 is connected to the base of the transistor $Tr_2$ via the resistor $R_6$.

The base of the transistor $Tr_3$ is connected to one end of the resistor $R_7$ and the base of the transistor $Tr_4$ is connected to one terminal of the resistor $R_8$. The other respective ends of the resistors $R_7$ and $R_8$, the emitters of the transistors $Tr_3$ and $Tr_4$, and the anodes of the diodes $D_3$ and $D_4$ are mutually connected, and the connecting point of the above is connected to ground.

The collector of the transistor $Tr_3$ and the cathode of the diode $D_3$ are connected to one input terminal of the cassette rotation motor 36, and the collector of the transistor $Tr_4$ and the cathode of the diode $D_4$ are connected to the other input terminal of the cassette rotation motor 36.

The motor drive circuit 52 is designed such that the rotatable cassette 32 in the first rotatable cassette unit 26 or the rotatable cassette 32 in the second rotatable cassette unit 27 are rotated to the lateral feed position (e.g., A4 or B5 position) when the output terminal CCW of the controller 51 is at a high level (with the output terminal CW being at a low level), and to the longitudinal feed position (e.g., A4R or B5R position) when the output terminal CW is at a high level.

The operation panel keys 55 include the "copy" button 41, the ten keys 42, the magnification setting keys 46, the cassette changeover key 47, the cassette rotation keys 48 and 49, and others which are all provided on the operation panel 40 of the main body 1.

The operation panel display unit 56 includes the copy number display 43, a magnification display 45, the paper size display lamps $PSL_1$ to $PSL_6$, the cassette display lamps $CSL_1$ to $CSL_6$ and others, which are all provide on the operation panel 40.

The memory 53 stores data regarding the longitudinal and lateral feed positions of the first and second cassette units 26 and 27 respectively provided with the rotatable cassettes 32. The memory 53*a* stores data regarding respective feeding numbers in longitudinal and lateral directions from the respective rotatable cassettes 32.

When one of the operation panel keys 55 is pressed, the controller 51 starts its control operation accordingly to the pressed key.

For example, when the rotation key 48 for the first rotatable cassette 26 is pressed for instructing to rotate the rotatable cassette 32 of the first rotatable cassette 26 from the lateral feed position to the longitudinal feed position, the level of the output terminal CW becomes high and the level of the output terminal CCW becomes low. On the other hand, if the key is operated for instructing to rotate the rotatable cassette 32 from the longitudinal feed position to the lateral feed position, the level of the output terminal CCW becomes high, and the level of the output terminal CW becomes low.

When the rotatable cassette 32 is rotated to the lateral feed position and the sensor $HP_1$ is turned ON (i.e., the light running in the photointerrupter is interrupted), the level of the output terminal CCW immediately becomes low, thereby halting the cassette rotation motor 36. Similarly, when the rotatable cassette 32 is rotated to the longitudinal feed position, and the sensor $HP_2$ is turned ON, the level of the output terminal CW immediately becomes low, thereby halting the cassette rotation motor 36.

Figure 1:
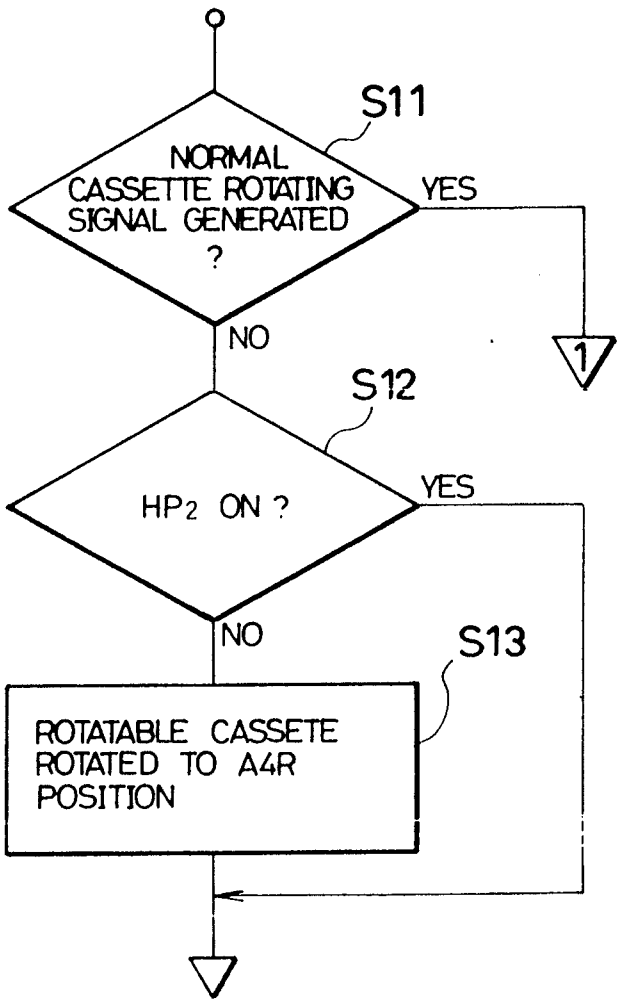
FIG. 1(*a*) is a flow chart showing the control operation of a controller when a normal cassette rotating signal is generated.
Figure 1:
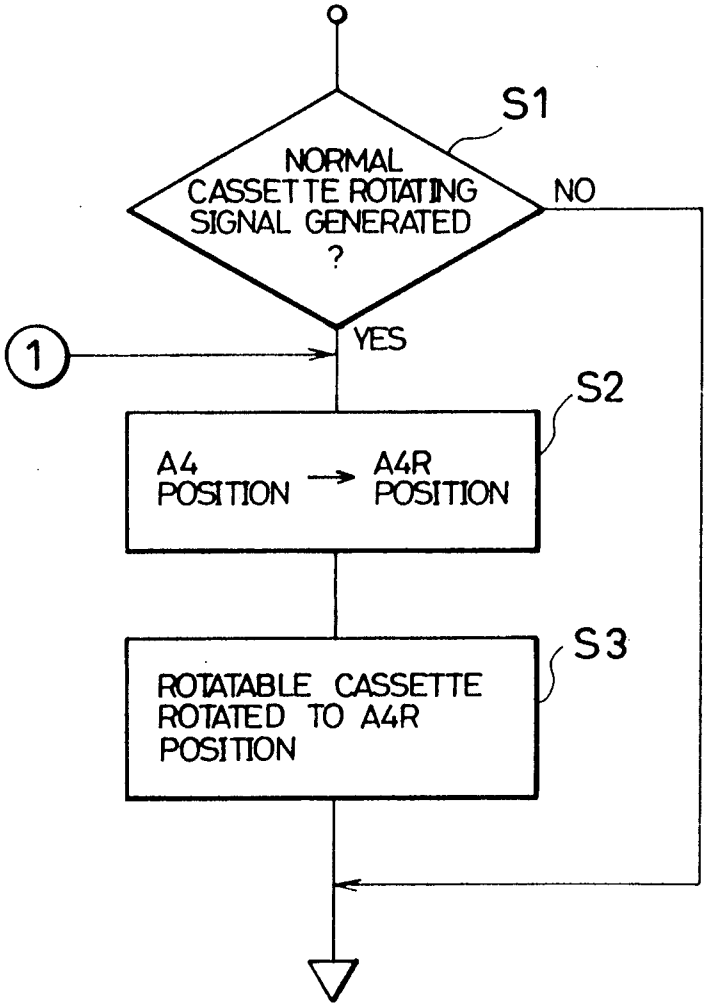

The controller 51 performs the controlling operation as shown in FIGS. 1(*a*) and (*b*), 2 and 3 (to be described later).

The following description describes the rotation of the rotatable cassette 32 of the first rotatable cassette unit 26.

Suppose that A4 size paper is stored in the rotatable cassette 32 in the first rotatable cassette unit 26 and the rotatable cassette 32 is positioned in the lateral feed position (i.e. A4 position). The sensor $HP_1$ is turned ON, and the display for the first rotatable cassette unit 26 on the operation panel display unit 56 indicates A4.

Figure 9:
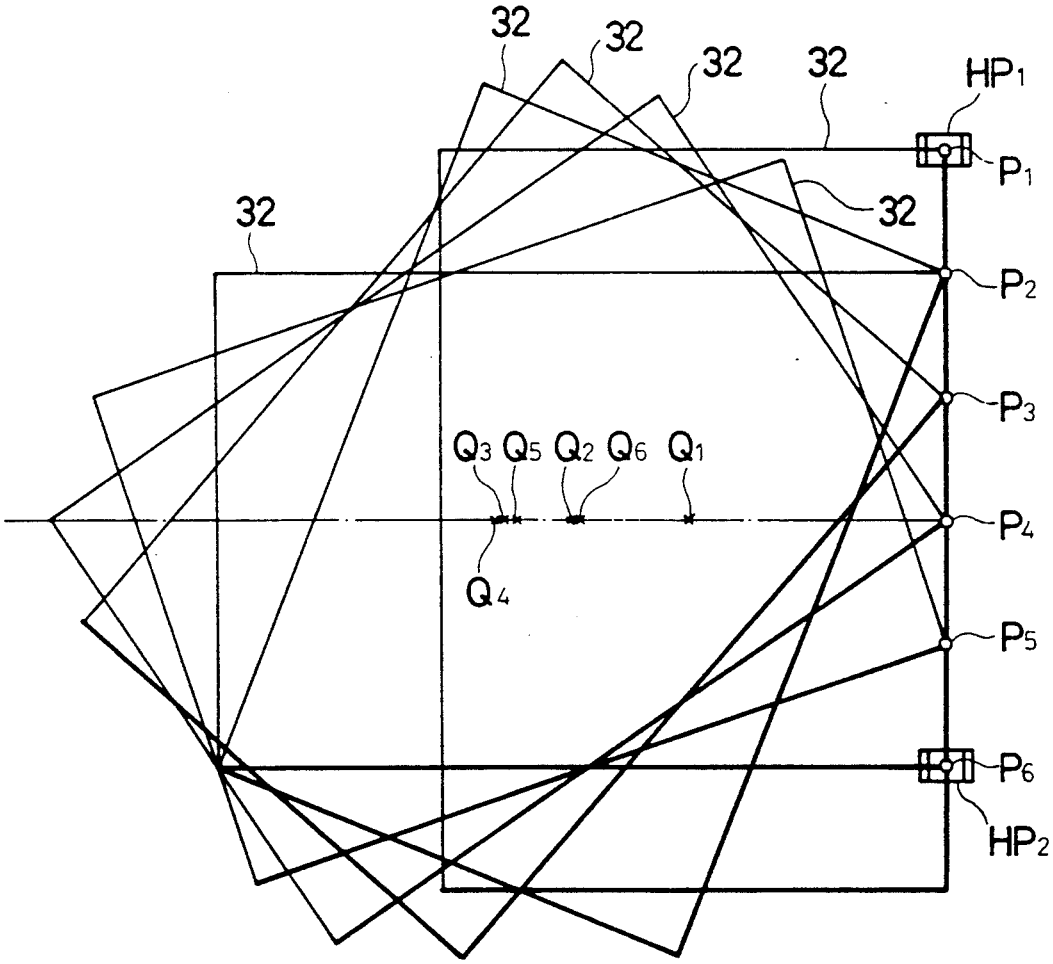
FIG. 9 is a diagram showing the rotating process of a rotation cassette.

At this time, the nut member 37 disposed at the threaded shaft 35 is located at the position $P_1$ as shown in FIG. 9.

When the cassette rotation key 48 for the first rotatable cassette unit 26 on the operation panel key 55 is operated, the output terminal CW of the controller 51 becomes high, and the output terminal CCW thereof becomes low. Then, the transistor $Tr_1$ and the transistor $Tr_4$ are turned ON, and current flows through the (+24V) power source, the transistor $Tr_1$, the cassette rotation motor 36, the transistor $Tr_4$ and ground in this order, thereby rotating the cassette rotation motor 36 in the CW direction (rotating in the direction C in FIG. 6(*a*)).

Accordingly, the threaded shaft 35 is rotated in the direction C. This rotation permits the nut member 37 to reciprocate between the position $P_1$ and the position $P_6$, and the guiding shaft 34 of the rotatable cassette 32 is rotatively slid within the guide hole 33*a* of the supporting plate 33 to reciprocate between the position $Q_1$ and the position $Q_6$.

Thereafter, the nut member 37 reaches the sensor $HP_2$ to turn ON the longitudinal position sensor $HP_2$, thereby halting the cassette rotation motor 36. At this stage, the rotatable cassette 32 is set in the predetermined longitudinal feed position (A4R position).

If the rotation key 48 is operated again in this stage, the output terminal CCW of the controller 51 becomes high, and the output terminal CW thereof becomes low. Then, the transistors $Tr_2$ and $Tr_3$ are turned ON, and current flows through the (+24V) power source, the transistor $Tr_2$, the cassette rotation motor 36, the transistor $Tr_3$ and ground in this order, thereby rotating the cassette rotation motor 36 in the CCW direction. This rotation permits the rotatable cassette 32 to rotate from the longitudinal feed position to the lateral feed position in the opposite process to the foregoing.

When the sensor $HP_1$ is turned ON, the cassette rotation motor 36 is halted and the rotatable cassette 32 is set in the predetermined lateral feed position.

Next, the main controlling operation of the controller 51 will be described hereinbelow in reference to the flow charts of FIGS. 1(*a*) and (*b*), 2 and 3.

FIG. 1(*a*) shows an example of the controlling operation in the case where the cassette rotation key 48 for the first rotatable cassette unit 26 is pressed in the feeding control program. The described operation for rotating the rotatable cassette 32 by position-specifying input means such as cassette rotation key 48 achieves an automatic rotating operation by a manual operation of the key according to a user's use to a priority feed position of the rotatable cassette 32.

Assume that A4 size papers are stored in the rotatable cassette 32 of the first rotatable cassette unit 26, that disposed at A4 position.

First, it is determined whether or not a cassette rotating signal is generated by operating, for example, the cassette rotation key 48 in S1. If not, the sequence moves to the process after S3.

On the other hand, if the cassette rotating signal is generated in S1, information in the memory 53, regarding the feed position of the rotatable cassette 32 is rewritten from A4 position to A4R position (S2). Then, the rotatable cassette 32 of the first rotatable cassette unit 26 is rotated to the A4R position (S3). Here, when the rotatable cassette 32 reaches the A4R position, the sensor $HP_2$ for detecting the longitudinal feed position is turned ON, whereby the controller 51 recognizes that the rotatable cassette 32 reaches the A4R position.

FIG. 1(*b*) shows an example of the controlling operation in the case where the rotatable cassette 32 is deviated from the A4R position in the paper feeding program.

When the rotatable cassette 32 of the first rotatable cassette unit 26 is at the A4R position, the sensor $HP_2$ for detecting the longitudinal feed position is set ON, whereas, the sensor $HP_2$ is set OFF when the rotatable cassette 32 is deviated from the A4R position.

First, it is determined whether or not the cassette rotating signal is generated (S11). If not, it is determined whether or not the sensor $HP_2$ is turned ON (S12).

If the cassette rotating signal is generated, i.e., when the longitudinal feed position sensor $HP_2$ is set OFF, the rotatable cassette 32 is rotated to the A4R position stored in the memory 53 (S13). In addition, if the cassette rotating signal is generated in S11, the sequence goes to S2 of FIG. 1(*a*).

Through the above-mentioned controlling process, even if the rotatable cassette 32 is deviated from a predetermined position due to some external force, the rotatable cassette 32 can be placed back to the predetermined position.

Figure 2:
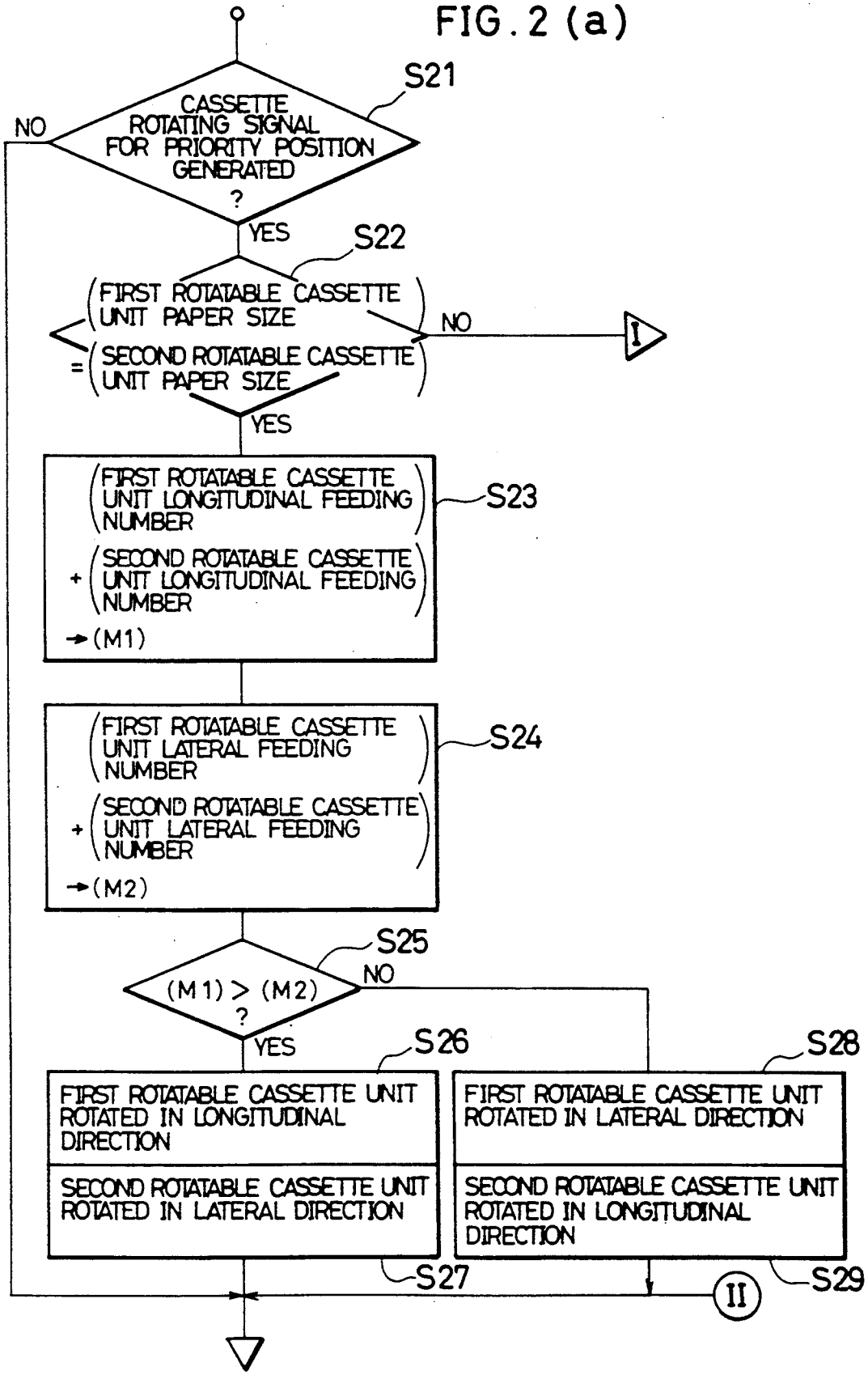
FIGS. 2(*a*) and (*b*) are respective flow charts showing the control operation of a controller when a cassette rotating signal for a priority position is generated.
Figure 2:
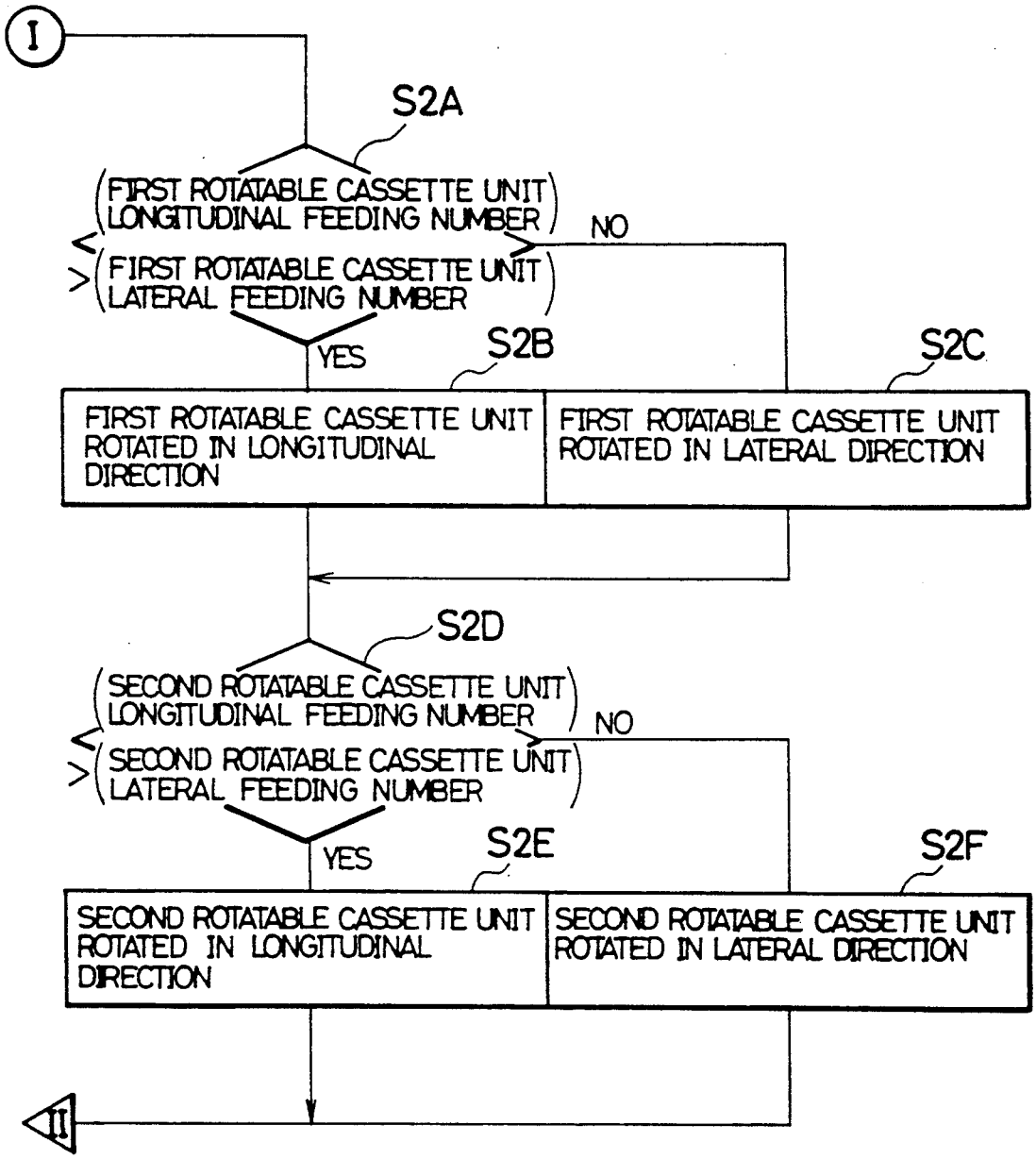

FIG. 2 shows the operating procedure when the cassette rotating signal indicating the priority position is generated in the paper feeding program.

First, it is determined whether or not the cassette rotating signal indicating the priority position is generated (S21). If not, the sequence moves to an operation after the step S27, S29, S2E and S2F.

On the other hand, if the cassette rotating signal is generated in S21, the sizes of the papers are compared between those stored in the first rotatable cassette unit 26 and those stored in the second rotatable cassette unit 27 (S22). If it is detected in S22 that both are of the same size, a feeding number stored in the memory 53 in the longitudinal direction from the first rotatable cassette unit 26 and that from the second rotatable cassette unit 27 are added, and the obtained sum is to be stored in the address M1 of the memory 53 (S23).

Next, a feeding number stored in the memory 53 in the lateral direction from the first rotatable cassette unit 26 and that from the second rotatable cassette unit 27 are added, and the obtained sum is to be stored in the address M2 of the memory 53 (S24).

Then, an comparison is made between data in the address M1 and data in the address M2 of the memory 53 in S25. If M1>M2, an instructing signal is generated for rotating the first rotatable cassette unit 26 in the longitudinal direction (S26), and thereafter an instructing signal is generated for rotating the second rotatable cassette unit 27 in the lateral direction (S27).

If M1≦M2 in S25, the instructing signal is generated for rotating the first rotatable cassette unit 26 in the lateral direction (S28), and thereafter, the instructing signal is generated for rotating the second rotatable cassette unit 27 in the longitudinal direction (S29).

On the other hand, when it is detected in the size comparison in S22 that the respective papers are of the different sizes, the respective numbers of feeding in lateral and longitudinal directions from the first rotatable cassette unit 26 are recalled from the memory 53, and the numbers are compared (S2A).

If the number of feeding in the longitudinal direction is greater than that in the lateral direction, the instructing signal is generated for rotating the first rotatable cassette unit 26 in the longitudinal direction (S2B). If the number of feeding in the longitudinal direction is smaller than that in the lateral direction, the instructing signal is generated for rotating the first rotatable cassette unit 26 in the lateral direction (S2C).

Next, the respective numbers of feeding in the longitudinal and lateral directions from the second rotatable cassette unit 27 are recalled from the memory 53, and the numbers are compared (S2D).

If the number of feeding in the longitudinal direction is greater than that in the lateral direction, the instructing signal is generated for rotating the second rotatable cassette unit 27 in the longitudinal direction (S2E). If the number of feeding in the longitudinal direction is smaller than that in the lateral direction, the instructing signal is generated for rotating the second rotatable cassette unit 27 in the lateral direction (S2F).

Using the described rotation instructing signals, the sensors $HP_1$ and $HP_2$ indicating respective positions are checked according to the flow of the controlling operation (not shown). If neither the sensor $HP_1$ nor the sensor $HP_2$ are turned ON, the priority of the feed position stored in the memory 53 is rewritten before rotating the rotatable cassette 32.

The described controlling process permits to automatically set the priority of the feed position to be the most often used feed direction.

Further, in the case where the papers of the same size are stored in the upper rotatable cassette 32 and the lower rotatable cassette 32 in the first rotatable cassette unit 26 and the second rotatable cassette unit 27, the most often used feed direction is set to be the priority of the feed direction, and the rotatable cassette 32 of either the first rotatable cassette unit 26 or the second rotatable cassette unit 27, having a shorter feeding path, i.e., the rotatable cassette 32 of the first rotatable cassette unit 26 is selected as a priority cassette. In this way, the faster copying operation can be achieved.

Figure 3:
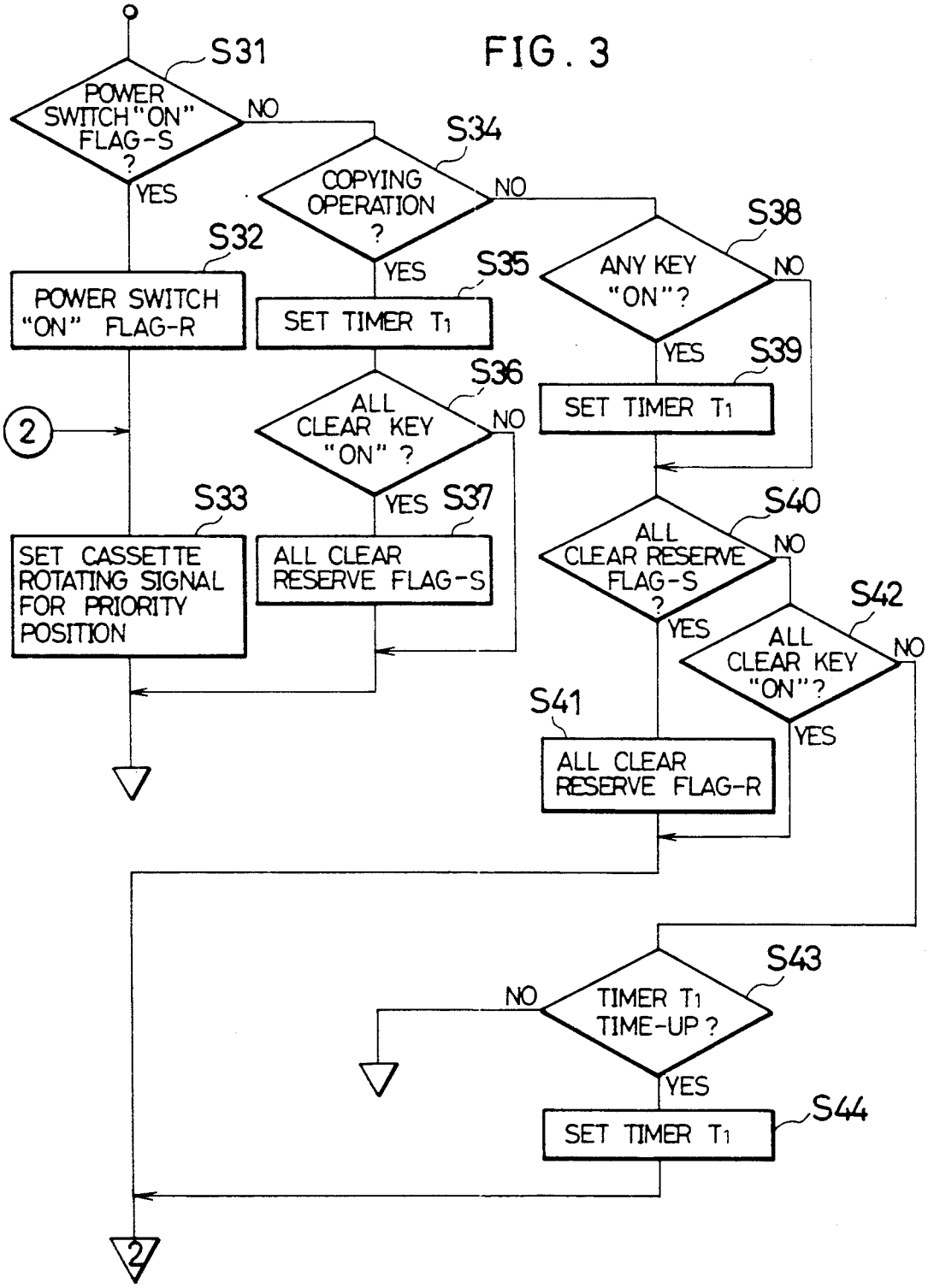
FIG. 3 is a flow chart showing an operation for generating a cassette rotating signal for a priority position by detecting a power ON state or an auto-clear state.

FIG. 3 shows an operation for generating a cassette rotating signal indicating the priority feed position.

First, it is determined whether or not a power switch ON flag is set ON that to ,be set according to an initialization routine (not shown) when the power switch is turned ON (S31). If so, the power switch ON flag is reset (S32). Then, a cassette rotating signal indicating the priority of the feed position is set (S33).

If not, on the other hand, whether or not a copying operation is in process (S34). If so, an auto-clear timer T1 is set (S35). Here, the timer T1 is arranged so as to count up in every predetermined time period in the case of, for example, a time-interruption processing of CPU (not shown).

Next, it is determined whether or not a release key (not shown) is pressed for changing the copy mode of the operation panel to the normal mode (S36). If so, an all clear reserve flag is set (S37).

If the copying operation is not in process in S34, it is determined whether or not any key on the, operation panel is set ON (S38). If so, the auto-clear timer T1 is set again (S39).

Then, it is determined whether or not the all clear reserve flag (to be set in S37) is set in S40. If so, the all clear reserve flag is reset (S41). Thereafter, the sequence goes back to S33. If not, on the other hand, it is determined whether or not the all clear key is set ON (S42). If so, the sequence goes back to S33.

If the all clear key is not set ON in S42, it is determined whether or not the time set by an auto-clear timer T1 is up (S43). If so, the timer T1 is reset (S44), and the sequence goes back to S33. If not, the above process is terminated, and the the sequence moves on to the next routine.

As described, according to the feeding device of the present invention, the rotatable cassette 32 can be automatically rotated in the most often used feed direction when the power switch is turned ON and when the auto-clear key or the all-clear key is set ON. Thus, a more efficient and convenient operating process can be achieved.

The position-specifying input means having the cassette rotation keys 48 and 49 are provided in the feeding device of the present invention. This permits rotating rotation of the rotatable cassette 32 according to the user's use based upon manual actuation of the keys.

While this invention has been disclosed in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A feeding device comprising:

paper storing means rotatable between a longitudinal feed position from which paper is fed in a longitudinal direction and a lateral feed position from which the paper is fed in a lateral direction;

rotation drive means for rotating said paper storing means to the longitudinal position or to the lateral position;

feeding number memory means for storing feeding numbers in the longitudinal direction and the lateral direction from said paper storing means; and control means for determining a priority feed direction based on the feeding numbers stored in said feeding number memory means and controlling said rotation drive means so as to rotate said paper storing means in the priority feed direction.

2. The feeding device of claim 1, wherein:

a plurality of said paper storing means are provided; and said rotation drive means rotates each of said plurality of paper storing means.

3. The feeding device of claim 2, wherein:

said control means adds feeding numbers from said plurality of paper storing means for the longitudinal and lateral feed directions and compares an obtained sum for the longitudinal direction with an obtained sum for the lateral direction to determine the priority feed direction and controls said rotation drive means to rotate said paper storing means with a shortest paper feed path in the priority feed direction when paper of a same size are stored in said plurality of said paper storing means.

4. The feeding device of claim 2, wherein:

the paper is fed through a single paper feed path from said plurality of said paper storing means.

5. The feeding device of claim 2, including:

selection-specifying input means for selecting a desired one of said plurality of paper storing means for feeding the paper and specifying the selected one of said plurality of paper storing means.

6. The feeding device of claim 1, including:

control-specifying means for sending a first instruction to said control means to control said rotation drive means based on the feeding numbers stored in said feeding number memory means.

7. The feeding device of claim 6, including:

position-specifying input means for sending a second instruction to said control means.

8. The feeding device of claim 1, including:

paper feed position detection means for detecting the longitudinal feed position and the lateral feed position of said paper storing means; and wherein said control means controls said rotation drive means so as to place said paper storing means in a predetermined longitudinal or lateral feed position upon detecting that said paper storing means is deviated from the predetermined longitudinal or lateral feed position.

9. The feeding device of claim 1:

said rotating drive means including drive means for generating a drive force for rotating said paper storing means; and transmission means for transmitting the drive force generated by said drive means to said paper storing means.

10. The feeding device of claim 9, wherein said drive means is a motor and said transmission means includes:

a threaded shaft, connected to one end of said motor, said threaded shaft being rotatably supported by bearings; and a nut member, fitted to said threaded shaft so as to reciprocate in an axis direction in accordance with a rotation of said threaded shaft.

11. The feeding device of claim 10, wherein an upper end of said nut member is rotatably connected to a corner of said paper storing means and a lower end of said nut member is provided with a light interrupting member.

12. The feeding device of claim 11, including:

paper feed position detection means for detecting the longitudinal feed position and lateral feed position of said paper storing means.

13. The feeding device of claim 12, wherein:

said paper feed position detection means is a photointerrupter including a light emitting element and a light receiving element, for outputting a detecting signal to said control means when light is interrupted by the light interrupting member.

14. The feeding device of claim 1, wherein said paper storing means includes:

guide member formed at a center of a reverse side thereof;

a rotating section being substantially 90° rotatable about said guide member; and a housing member for housing said guide member and said rotating section.

15. A method for rotating a paper storing cassette to a priority feed position comprising the steps of:

(a) determining whether a cassette rotating signal is generated, indicating that control of the priority feed position has started;

(b) comparing respective feeding numbers from longitudinal and a lateral feed positions stored in a feeding number memory when the cassette rotating signal is generated; and (c) rotating the paper storing cassette in a feed direction of a greater feeding number.

16. The method of claim 15, wherein a plurality of paper storing cassettes are provided, and when the cassette rotating signal is generated, said method includes the steps of:

(d) comparing respective paper sizes stored in the plurality of paper storing cassettes;

(e) adding respective feeding numbers stored in the feeding number memory in a longitudinal direction from the plurality of paper storing cassettes when the paper stored therein are of the same size;

(f) adding respective feeding numbers stored in the feeding number memory in a lateral direction from the plurality of paper storing cassettes when the papers stored therein are of the same size;

(g) comparing respective sums of the feeding numbers for the longitudinal and lateral feed directions; and (h) rotating one of the plurality paper storing cassettes with a shortest paper feed path in a feed direction of the greater feeding number sum.

17. The method of claim 15, further comprising including the steps of:

(i) determining whether a power switch ON flag is set, according to an initialization routine when the power switch is turned ON; and (j) setting the cassette rotating signal when the power switch ON flag is set.

18. The method of claim 17, further comprising the steps of:

(k) determining whether a copying operation is in process when the power switch ON flag is not set;

(l) determining whether an all clear reserve flag is set by pressing an all clear key when the copying operation is not in process;

(m) setting the cassette rotating signal when the all clear reserve flag is set.

19. The method of claim 17, further comprising the steps of:

(n) setting a timer when the copying operation is not in process; and (o) setting the cassette rotating signal when a time set by said timer has elapsed.

* * * * *